US005737677A

United States Patent [19]

Tombs et al.

[11] Patent Number: 5,737,677

[45] Date of Patent: Apr. 7, 1998

[54] APPARATUS AND METHOD OF TONER TRANSFER USING NON-MARKING TONER

[75] Inventors: Thomas Nathaniel Tombs, Brockport; John Walter May, Rochester; Donald Saul Rimai; Robert E. Zeman, both of Webster, all of N.Y.

[73] Assignee: Eastman Kodak Company, Rochester, N.Y.

[21] Appl. No.: 572,559

[22] Filed: Dec. 14, 1995

Related U.S. Application Data

[60] Provisional application Nos. 60/003,013, Aug. 31, 1995 and 60/003,014, Aug. 31, 1995.

[51] Int. Cl.[6] ..... G03G 15/16

[52] U.S. Cl. ..... 399/296; 399/298; 399/302

[58] Field of Search ..... 399/296, 297, 399/298, 302, 308

[56] References Cited

U.S. PATENT DOCUMENTS

| | | | |
|---|---|---|---|
| 3,813,267 | 5/1974 | Honjo et al. | 156/236 |
| 3,901,698 | 8/1975 | Fukushima et al. | 96/1 R |
| 4,040,828 | 8/1977 | Evans | 96/1.2 |
| 4,064,285 | 12/1977 | Mammino | 427/24 |
| 4,066,802 | 1/1978 | Clemens | 427/24 |
| 4,078,929 | 3/1978 | Gundlach | 96/1.2 |
| 4,175,958 | 11/1979 | Naganuma et al. | 430/49 |
| 4,216,283 | 8/1980 | Cooper et al. | 430/110 |

(List continued on next page.)

FOREIGN PATENT DOCUMENTS

| | | |
|---|---|---|
| 91450 | 12/1982 | Australia . |
| 91586 | 12/1982 | Australia . |
| 989683 | 5/1976 | Canada . |
| 0 554 981 | 11/1993 | European Pat. Off. . |
| 0 629 921 A1 | 12/1994 | European Pat. Off. . |
| 3148505A1 | 6/1983 | Germany . |
| 59-25215 | 3/1975 | Japan . |
| 62-294423 | 5/1989 | Japan . |
| 63-273988 | 5/1990 | Japan . |

OTHER PUBLICATIONS

U.S. Provisional Application 60/003,014, filed Aug. 31, 1995, Tombs et al.

U.S. Application, Ser. No. 08/572,360, filed Dec. 14, 1995, May et al.

*Primary Examiner*—William J. Royer
*Attorney, Agent, or Firm*—Doreen M. Wells

[57] ABSTRACT

A method and apparatus for forming a desired image on a receiver are disclosed. The method comprises transferring marking toner particles from an intermediate transfer member to a receiver in the presence of an electric field which urges the marking toner particles toward the receiver. When transferring the marking toner particles to the intermediate transfer member, the surface of the intermediate transfer member contacts non-marking toner particles in some areas which receive marking toner particles. The intermediate transfer member comprises a blanket layer having a Young's modulus of about $10^8$ Newtons/$m^2$ or less.

40 Claims, 3 Drawing Sheets

U.S. PATENT DOCUMENTS 4,294,902 10/1981 Takashima et al. ..... 430/45
4,367,276 1/1983 Cooper et al. ..... 430/126
4,368,250 1/1983 Cooper et al. ..... 430/109
4,370,400 1/1983 Cooper et al. ..... 430/126
4,464,453 8/1984 Cooper et al. ..... 430/126
4,562,129 12/1985 Tanaka et al. ..... 430/42
4,562,130 12/1985 Oka ..... 430/54
4,600,669 7/1986 Ng et al. ..... 430/47
4,686,163 8/1987 Ng et al. ..... 430/47
4,921,768 5/1990 Kunugi et al. ..... 430/45
4,927,727 5/1990 Rimai et al. ..... 430/99
4,935,788 6/1990 Fantuzzo et al. .
4,986,211 1/1991 Coulter, Jr. et al. ..... 118/644
5,021,318 6/1991 Mayo et al. ..... 430/124
5,037,718 8/1991 Light et al. ..... 430/126
5,043,242 8/1991 Light et al. ..... 430/126
5,045,426 9/1991 Maierson et al. ..... 430/126
5,045,888 9/1991 Imaeda .
5,075,186 12/1991 Sheridon ..... 430/47
5,079,115 1/1992 Takashima et al. ..... 430/45
5,084,735 1/1992 Rimai et al. .
5,102,767 4/1992 Chowdry et al. ..... 430/126
5,104,765 4/1992 Chowdry et al. ..... 430/126
5,108,865 4/1992 Zwaldo et al. ..... 430/126
5,147,745 9/1992 Russel ..... 430/49
5,156,915 10/1992 Wilson et al. ..... 428/425.8
5,184,183 2/1993 Karidis et al. .
5,187,526 2/1993 Zaretsky .
5,212,032 5/1993 Wilson et al. ..... 430/65
5,217,838 6/1993 Wilson et al. ..... 430/126
5,233,396 8/1993 Simms et al. .
5,234,783 8/1993 Ng ..... 430/45
5,250,357 10/1993 Wilson et al. ..... 428/425.8
5,260,753 11/1993 Haneda et al. .
5,370,961 12/1994 Zaretsky et al. ..... 430/126
5,561,510 10/1996 Kamp et al. ..... 399/308

APPARATUS AND METHOD OF TONER TRANSFER USING NON-MARKING TONER

CROSS REFERENCE TO RELATED APPLICATION

Reference is made to and priority claimed from U.S. Provisional application Ser. No. 60/003,013 filed 31 Aug. 1995, entitled APPARATUS AND METHOD OF TONER TRANSFER USING NON-MARKING TONER and U.S. Ser. No. 60/003,014 filed 31 Aug. 1995, entitled APPARATUS AND METHOD OF TRANSFERING TONER USING NON-MARKING TONER AND MARKING TONER.

FIELD OF THE INVENTION

The present invention relates to electrophotography and more particularly to apparatus and methods of using non-marking toner and compliant intermediate transfer members to improve the transfer of toner images to and from intermediate transfer members.

BACKGROUND OF THE INVENTION

In a conventional color electrostatographic copying or printing process, several electrostatic images are formed sequentially on an image member, each electrostatic image representing the cyan, magenta, yellow and black color separations of a desired final toner image. These electrostatic images are toned with charged toner particles containing appropriate colorants to produce toned electrostatic images. These toned electrostatic images may be sequentially transferred to an intermediate transfer member on top of each other in registration to create a multi-color toner image. From the intermediate transfer member (ITM) the multi-color toner image is transferred to a receiver and then the multi-color toner image is fixed to the receiver by a suitable method, such as by pressurized contact with a heated fusing roller.

To produce high quality pictorial images using electrophotographic methods requires very high transfer efficiency of small toner particles to the final receiver, e.g., paper. Incomplete toner transfer is an important obstacle to producing high quality images, especially color images. With color images the problems are magnified by the need to transfer multiple images (each color separation) either simultaneously or sequentially on top of each other. In addition, high quality color images require efficient transfer in low density toner areas for acceptable tone reproduction.

As noted, it is important to get high transfer efficiency, particularly in low density areas. One of the image characteristics that is difficult to achieve, particularly if the transfer efficiency is not high, is low "mottle". Mottle is a non-imagewise variation in the density of the image. The problem is magnified when the image is a multi-color image and the toner particles are small, e.g. less than 15 μm (volume weighted diameter).

One type of electrophotographic process involves the transfer of toner images to an intermediate transfer member and then subsequently to the final receiver. Rimai et al. (U.S. Pat. No. 5,084,735) have shown that an intermediate transfer member (ITM) can be formulated having a bilayer structure consisting of a compliant layer with a thin, less compliant overcoat layer. However, the transfer efficiency of the Ritual et al ITM is still less than desired, particularly with small toner particles in low density regions.

S. Volkers (Xerox) European Application 93300364.2 discloses the use of a non-marking toner layer on an ITM.

However, there is no mention of the bulk characteristics of the ITM, e.g., the compliance as measured by the Young's modulus.

There is a continuing need for improving the transfer efficiency of toner particles to and from an intermediate transfer member so as to improve the image characteristics of the final toner image, particularly in low density toner areas.

SUMMARY OF THE INVENTION

In accordance with the present invention, there is provided a method and apparatus which form a desired toner image on a receiver by:

forming at least one electrostatic image on at least one imaging member;

toning at least one said electrostatic image with marking toner particles of at least one color;

transferring said marking toner particles from at least one said imaging member to the surface of an intermediate transfer member in the presence of an electric field which urges said marking toner particles toward said intermediate transfer member;

transferring said marking toner particles from said intermediate transfer member (ITM) to a receiver in the presence of an electric field which urges said marking toner particles toward said receiver;

wherein, when transferring said marking toner particles to said intermediate transfer member from at least one said imaging member, said surface of said intermediate transfer member contacts non-marking toner particles at least in some areas which receive marking toner particles, and wherein said intermediate transfer member comprises a blanket layer having a Young's modulus of about $10^8$ Newtons/$m^2$ or less.

The advantages of the method and apparatus of the invention, which provide and use a compliant ITM and the presence of non-marking toner on the ITM, are that the transfer efficiency of the marking toner particles from the imaging member to the ITM is unexpectedly increased by the presence of the non-marking toner, and the transfer efficiency from the ITM to the receiver is also remarkably increased. The transfer efficiencies are particularly increased for small toner particles, e.g. less than about 15 μm, more preferably less than 9 μm (volume weighted diameter). The image quality, as exemplified by mottle in low density toner areas, is exceptionally improved and is particularly noticeable in multi-color toner images. Improved transfer has the additional advantage of reducing the need to clean the imaging member and the ITM.

DESCRIPTION OF THE PREFERRED EMBODIMENTS

Figure 1:
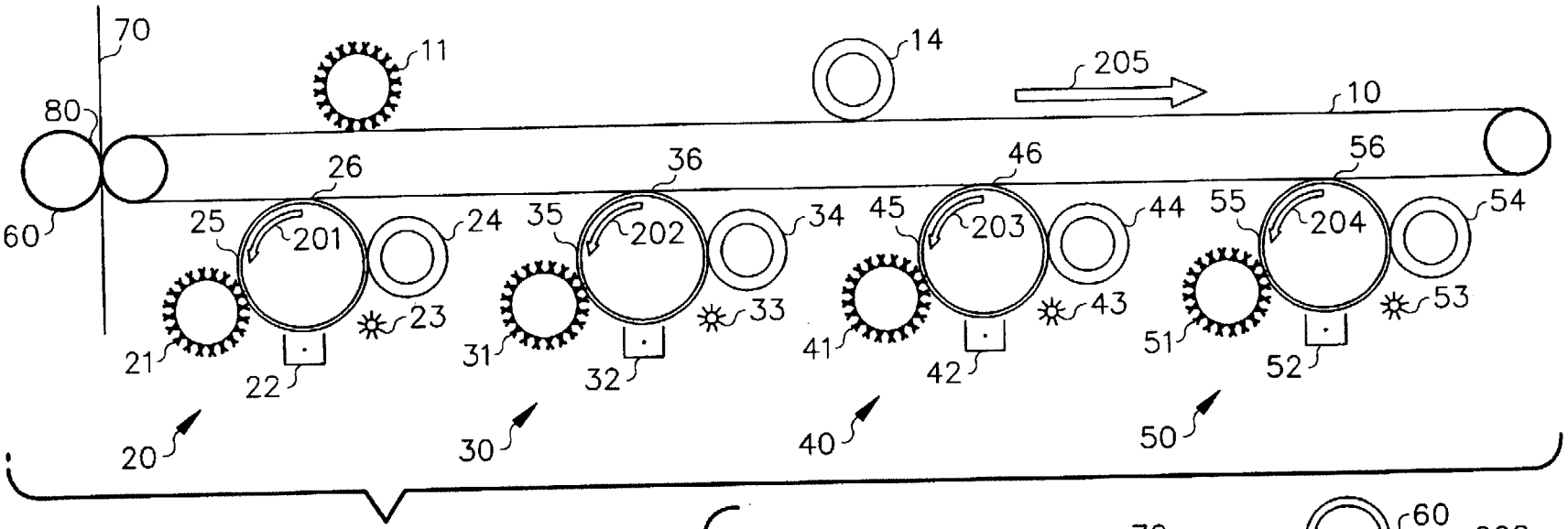
FIG. 1 is a diagrammatical view of an apparatus of the invention for carrying out the method of the invention.

The term "imaging member" refers to a member onto which an electrostatic image is formed, such as, photoconductive elements, dielectric elements and electrographic masters.

The term "bias development", as used herein, means depositing charged toner particles from a development station biased with a voltage to urge the toner particles to a member, for example, an ITM or imaging member. The member can also be biased with a voltage to urge the toner particles from the development station to the member.

The term "monolayer", as used herein, means a substantially full coverage of toner particles making up a single layer such that the addition of more toner particles forms a second layer of toner.

The terms "toner density" or "transmission density", as used herein, means the optical density as measured on a fused toner image by an optical densitometer using white light in the transmission mode, using, for example an X-rite® Photographic Densitomer model 310. The term "reflection density" means the optical density as measured on a fused toner image by an optical densitometer using white light in the reflection mode. For the measurements of transmission density and reflection density specified herein, the fused toner image was prepared by placing an unfused toner image on a receiver in an oven at 160° C. for 30 seconds. The transmission and reflection density of the receiver is nulled or subtracted from these measurements. For opaque receivers, the transmission density measurement should be made on a transparent receiver having an equivalent amount of toner.

The term "particle size", as used herein, or the term "size", or "sized" as employed herein in reference to the term "particles", unless otherwise indicated, means the mean volume weighted diameter as measured by conventional diameter measuring devices, such as a Coulter Multisizer, sold by Coulter, Inc. Mean volume weighted diameter is the sum of the mass of each particle times the diameter of a spherical particle of equal mass and density, divided by total particle mass.

The term "glass transition temperature" or Tg as used herein means the temperature at which an amorphous material changes from a solid state to a rubbery state. This temperature can be measured by differential thermal analysis as disclosed in N. F. Mott and E. A. Davis, "Electronic Processes in Non-Crystalline Materials," Oxford Press (1971).

The term "receiver" as used herein refers to a substrate upon which a toner image is transferred and subsequently heat fused or otherwise fixed to produce a final image. Examples of suitable receivers include paper and plastic film such as films of polyethylene terephthalate, polycarbonate, or the like, which are preferably transparent and therefore useful in making transparencies. Paper is a presently preferred class of receiver, particularly smooth papers such as clay or polymer coated papers.

The term "imagewise" as used herein means corresponding to a desired toner image to be produced. The term "non-imagewise" means not containing any information corresponding to a desired final toner image to be produced. Typically a non-imagewise lay-down of non-marking toner means a substantially uniform flat-field deposit.

The apparatus and method of this invention can be an electrostatographic apparatus and method in general, but are preferably a xerographic apparatus and method, and most preferably a multi-color xerographic apparatus and method.

The method of this invention can be used when making contone or other image types, such as half-tone images using dots or line screens. For half-tone images using dots or line screens, the expression "areas to receive marking toner particles" or similar expressions having the same meaning, can include sub-areas within, for example a character or line, which will not receive toner, because of the half-tone system. Most of the description below contemplates the method of this invention using a contone system, but the method as described is easily adapted to a half-tone system by a person of ordinary skill in the art, and is within the scope of the invention.

Figure 2:
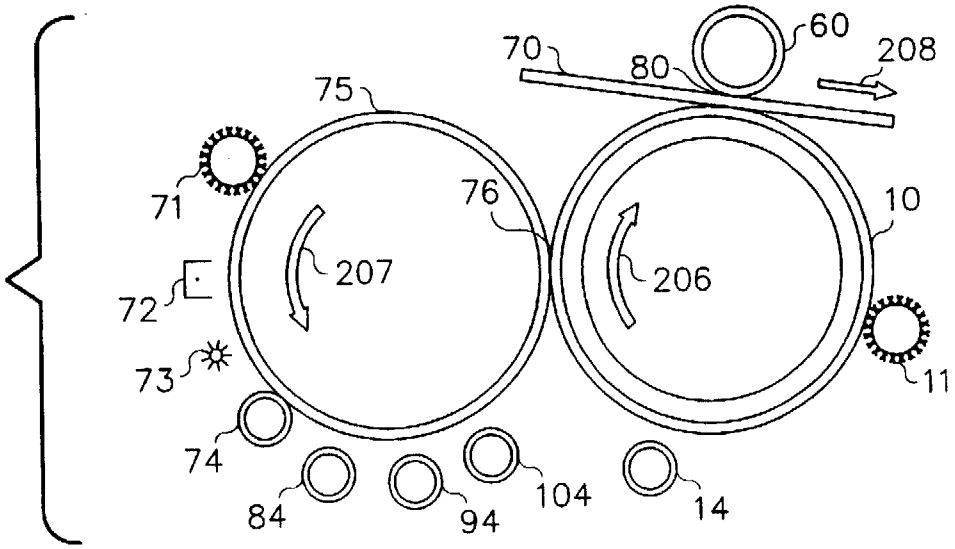
FIG. 2 is a diagrammatical view of an apparatus of the invention for carrying out the method of the invention.

In the apparatus and method of this invention more than one imaging member, as defined above, can be used. Typically, an apparatus for making single color final toner images has a single imaging member, and an apparatus for making multi-color final toner images has either one or more than one imaging members. To make multi-color toner images, a single imaging member can be used to make each individual electrostatic image for each color separation and then the individual color toner images are transferred from the imaging number to the ITM sequentially and in registration. The method consists of forming one electrostatic image on an imaging member corresponding to one color in the desired toner image; toning by applying the corresponding color marking toner particles to the electrostatic image to form an individual color toner image; and transferring the individual color toner image to the surface of an ITM in the presence of an electric field which urges the individual toner image toward the ITM and repeating the forming, toning and transferring steps for each color separation in a desired toner image. An example of this embodiment is shown in FIG. 2 which is described below.

In another embodiment, a single imaging member is used to make the individual electrostatic images for each color separation of a desired toner image, in registration, on top of each other on the imaging member. In this embodiment to create a multi-color image, at least two electrostatic images are formed and toned, sequentially, in registration on the same frame of the imaging member with marking toners of at least two different colors, and then the layers of the different marking toners are transferred simultaneously to an ITM in the presence of an electric field which urges the marking toner particles toward the ITM. This method is described in Gundlach, U.S. Pat. No. 4,078,929, incorporated herein by reference.

Alternatively, more than one imaging member can be present in an apparatus to simultaneously form electrostatic images for the different color separations of one or more final toner images. An example of this embodiment is shown in FIG. 1 which is described below.

An additional imaging member can be incorporated into an apparatus of this invention for the application, either imagewise or non-imagewise, of the non-marking toner particles to the ITM.

The apparatus of this invention can have any known means for establishing imagewise electrostatic charge on the imaging member(s). The most preferred means is to use a corona or roller charger to deposit a uniform electrostatic charge on imaging member(s), preferably photoconductive imaging member(s), and then to expose the photoconductive imaging member(s) to light from one or more exposing devices which reduces some of the charge on the photoconductive imaging member(s) to create an imagewise charge also referred to as an electrostatic image, sometimes referred to as an electrostatic latent image, on the photoconductive imaging member(s).

The apparatus of this invention has at least one development station for marking toner particles, also referred to as a "marking development station". An apparatus having one marking development station produces single color toner final images. An apparatus with multiple marking development stations for different color marking toners can be used to produce single color or multi-color final toner images. It is preferred that each marking development station has the capacity to create a voltage difference between the marking development station and the imaging member so that marking toner particles are urged to transfer from the marking development station and electrostatically adhere to the imaging member to form a toned electrostatic image on the imaging member.

Preferably, the apparatus has a development station for non-marking toner particles, referred to as a "non-marking development station". It is preferred that the non-marking development station has the capacity to create a voltage difference between the non-marking development station and the imaging member so that non-marking toner particles are urged to transfer from the non-marking development station to the imaging member or ITM.

Various techniques for depositing both the marking and the non-marking toners from marking and non-marking development stations preferably bias development stations to a member may be used. Examples include contact deposition, such as by using a magnetic brush, or non-contact deposition, such as by projection toning and powder cloud development.

This invention provides that non-marking toner contacts the ITM at least in some areas to receive marking toner particles. Areas to receive marking toner on the ITM are areas where marking toner are to be transferred to the ITM. The non-marking toner can be present everywhere in an image frame on the ITM or it can be present only, or at least, in areas which receive marking toner particles. An image frame on the ITM is an area on the ITM equal to the area of an image frame on the imaging member, i.e. the area in which imaging information including both toner and non-toner areas is present for an image. Alternatively, the non-marking toner particles can be present only, or at least, in areas to receive marking toner particles below a predetermined transmission density. The predetermined transmission density can be the marking toner density at and above which the presence of the non-marking toner on the ITM does not significantly improve the transfer of marking toner to or from the ITM. The predetermined transmission density can be determined for a particular apparatus and toner system by transferring different amounts of marking toner to and from the ITM with and without non-marking toner contacting the ITM, for example as described in Example 1. The marking and non-marking toner is then transferred to a receiver and fused. The transmission density is measured on the fused marking toner image where the non-marking toner was present on the ITM and compared to the transmission density of the marking toner where non-marking toner was not present on the ITM. The percent difference in the transmission density is calculated. A 5 percent and greater increase in the marking toner density due to the presence of the non-marking toner on the ITM is considered significant and the predetermined transmission density can be the transmission density measured on the fused toner image created by the method of this invention providing that percent increase in transmission density.

It has been determined that the benefits from the presence of non-marking toner on the intermediate transfer member are greatest in areas that receive small amounts of marking toner, that is, toner at low transmission densities. For the apparatus of this invention applying non-marking toner to the ITM in areas which receive marking toner at a transmission density below about 0.6 will provide the most benefit. This value for the transmission density was measured on marking toner images made by the method of this invention and fused on the receiver in a convection oven at 160° C. for thirty seconds to create a fused toner image.

In alternative embodiments, non-marking toner can be applied to the ITM for marking toner areas below a predetermined transmission density, and for marking toner areas above a predetermined transmission density. The amount of non-marking toner applied to the ITM for marking toner areas greater than the predetermined transmission density can be inversely proportional to the amount of marking toner to be transferred to the ITM. Further, areas on the ITM to receive marking toner above a second predetermined transmission density for high density marking toner areas can contact no non-marking toner. High density marking toner areas can be marking toner areas for which a reflection density of the final image is saturated, typically at a transmission density of 1.8 or greater. The reflection density is saturated or has reached a maximum value when additional non-marking toner does not increase the reflection density of the fused toner image. For example, in one embodiment of the invention, the ITM may contact non-marking toner particles only in areas which receive marking toner particles below a transmission density of 1.8. For areas of marking toner between high and low transmission densities, for example, 0.6 and 1.8, the amount of non-marking toner present on the ITM may be adjusted to be less than the amount present in the low density areas. For example, a monolayer of non-marking toner can contact the ITM in high density marking toner areas, and three layers of non-marking toner can contact the ITM in low density marking toner areas.

It is preferred that at least a monolayer of non-marking toner particles is present on the ITM at least in marking toner areas of low density, and it is more preferred that a monolayer to 3 layers of non-marking toner particles are present on the ITM under the marking toner particles.

The non-marking toner can be deposited on the ITM in a variety of ways. For example, the non-marking toner particles can be applied to the ITM from an imaging member or from another member or can be applied directly to the ITM from a non-marking development station prior to the transfer of the marking toner particles from an imaging member to the ITM. The non-marking toner particles can be applied directly to the ITM from a development station typically non-imagewise by bias development. Alternatively, the non-marking toner particles can be applied imagewise or non-imagewise to an imaging member prior to transferring the non-marking toner to the surface of the ITM. To apply the non-marking toner non-imagewise to an imaging member, non-marking toner can be bias developed to a uniformly charged imaging member. To apply the non-marking toner imagewise, preferably a uniform charge is applied to an imaging member. The imaging member, preferably a photoconductive imaging member, is exposed to light to form an electrostatic image on the imaging member corresponding to all the marking toner areas in a desired toner image, and the electrostatic image is toned with non-marking toner particles from a development station. This electrostatic image for toning with non-marking toner particles can be created by exposing a charged imaging member by an exposing device i.e., to reflected light of an original on a platen or to light from a computer controlled laser or light emitting diodes (LED). The latter method, using a computer controlled LED or laser, can be used to selectively apply non-marking toner to the ITM. For example, non-marking toner can be applied only in areas on the ITM that will receive marking toner(s)

either with individual or combined marking toner densities less than a predetermined transmission density.

One method of applying the non-marking toner to the ITM, which may be the preferred method when producing images, for example, which have pictorial portions and textual portions in a single image, is to apply the non-marking toner everywhere in a predetermined area (e.g. the pictorial area) of the image frame and in the areas to receive marking toner particles in the textual portions of the image frame outside the predetermined area. A single image may have one or more predetermined areas. This method is preferred when producing images which have pictorial portions and textual portions in a single image, because in the final toner image the entire predetermined area will have a uniform gloss even in areas where there is no marking toner present and the textual portions will have non-marking toner present only in areas where the marking toner(s) is(are) present.

For the imagewise application of non-marking and marking toner to the ITM, the color information of a desired toner image may be analyzed. For example, an original image can be scanned by an input digital scanner or the original image information can be generated by a digital computer and the image information stored in a buffer or other memory. A digital computer can be part of the apparatus of this invention to utilize input of the image information from the buffer to establish and provide appropriate bit maps to one or more drivers, for example, LED or laser drivers which control the exposing device, for example, a laser or LED. The controller provides to the drivers one bit map for the non-marking toner image and a bit map for each of the color separations making up a final toner image. The electrostatic images for the non-marking toner and for each color in a final image can be formed sequentially or simultaneously on one or more imaging members, toned with the appropriate and corresponding color or non-marking toner, transferred to the ITM either sequentially or simultaneously, and then simultaneously transferred from the ITM to the receiver. The forming, toning and transferring steps can occur by the methods described above.

The computer can be programmed to formulate the bit map for the non-marking toner by analyzing the image information and exposing or not exposing the imaging member to be toned with non-marking toner based on the image information. The computer can be programmed to form an electrostatic image for toning with non-marking toner in for example all areas where marking toners will be present, or only in areas where marking toners will be present above or below a predetermined transmission density. The electrostatic image can also be formulated to be toned with different amounts of non-marking toner in different areas. The non-marking toner is then transferred to the ITM from the imaging member prior to the transfer of marking toners to the ITM.

For example, in an embodiment where multiple separate color toner images are transferred from the imaging member to the ITM in series, and the non-marking toner is applied to the ITM only in areas to receive marking toner below a predetermined transmission density, for example, in areas receiving marking toner having a transmission density below 0.6, each color separation is analyzed to determine the low density toner areas, which will receive non-marking toner. To insure that the transfer of, for example, two color separations is aided by the presence of the non-marking toner on the ITM, the computer generates a bit map for the non-marking toner which is used as described above to expose an imaging member, develop and transfer non-marking toner to the ITM. The bit map will be established to apply non-marking toner in areas where the first color marking toner of the first color marking toner image to be transferred to the ITM has a density below the predetermined density (below 0.6), and where the combined density of the first and second color marking toners of the first and second color marking toner images to be transferred to the ITM are below the predetermined density (below 0.6). If a third color marking toner of a third color marking toner image is transferred to the ITM, then the non-marking toner would also be applied to the ITM where the first, second, and third color marking toners of the first, second, and third color marking toner images have a combined density below the predetermined density (below 0.6).

In other embodiments, the non-marking toner can be applied so that the total thickness of the marking and non-marking toner on the ITM is substantially uniform or approaches uniform thickness in all areas prior to the transfer of the marking and non-marking toner from the ITM to the receiver. This process is referred to as stack height leveling. This embodiment can be accomplished following computer analysis of the color information of a final toner image.

In other embodiments, the non-marking toner particles are transferred from an imaging member at the same time as the transfer of at least a first color of marking toner particles from an imaging member to the ITM. In one such embodiment, non-marking toner is bias developed on top of the marking toner while it resides on the imaging member, followed by subsequent transfer of both marking and non-marking toner. The frame containing the marking toner image on the imaging member can be recharged and optionally selectively exposed so that, following development with non-marking toner, the non-marking toner forms a non-imagewise or imagewise deposit. The marking toner and the non-marking toner are then simultaneously transferred to the ITM.

In another embodiment of the invention, sandwiches of non-marking toner/marking toner/non-marking toner etc. are formed on the ITM. To form the sandwiches, non-marking toner particles can be applied to the ITM directly from a non-marking development station before and after the transfer of each color marking toner image from the imaging member(s). Alternatively, non-marking toner can be applied over at least one marking toner image on the imaging member(s) and then each non-marking toner/marking toner sandwich can be transferred simultaneously from the imaging member(s) to the ITM. This can be accomplished by forming and toning a first electrostatic image for marking toner, as described above, and then forming a second electrostatic image over the marking toner particles on the imaging member and toning the second electrostatic image by applying the non-marking toner particles to the second electrostatic image.

The preferred method for applying non-marking toner particles to the ITM may depend on the characteristics of the receiver and the image. For a glossy receiver or a pictorial document, the preferred method is to directly apply the non-marking toner particles to the ITM non-imagewise from a separate development station prior to the transfer of any marking toner particles from any imaging member to the ITM. For non-glossy paper receivers, the preferred method is to transfer the non-marking toner particles to the ITM imagewise from an imaging member prior to the transfer of any marking toner particles from any imaging member to the ITM.

The intermediate transfer member can be a drum, web or endless belt which includes a layer having a Young's modulus of about $10^8$ Newtons/m$^2$ or less, more preferably between $10^6$ and $5\times10^7$ Newtons/m$^2$, most preferably between $2\times10^6$ and $10^7$ Newtons/m$^2$. The Young's modulus can be conveniently measured using an Instron Tensile Tester®.

It is preferred that the intermediate transfer member is a drum, also referred to as a roller. The drum can have an electrically conductive metallic core onto which is coated a layer of an elastomeric material having a Young's modulus of $10^8$ Newtons/m$^2$ or less. This elastomeric layer will be referred to herein as the "blanket" or "blanket layer". The blanket is preferably between about 0.5 mm and 10 mm thick and preferably has an electrical resistivity between about $10^6$ and $10^{12}$ Ohm-cm, which can be achieved by adding conductivity enhancing material, such as an antistat, to the elastomeric material. Suitable elastomeric materials are polyurethanes, silicones, and fluorinated polyethers. The preferred materials are polyurethanes having suitable addenda to achieve the desired properties. Particularly preferred materials for the ITM are described in U.S. Pat. Nos. 5,212,032; 5,156,915; 5,217,838; and 5,250,357, incorporated herein by reference.

The ITM preferably has an overcoat layer on the blanket. This overcoat preferably is not as thick as the blanket. The overcoat layer preferably consists of a material having a Young's modulus greater than $10^8$ Newtons/m$^2$. The overcoat layer preferably has a thickness less than 20 μm, more preferably between 0.01 to 10 μm. It is preferred that the resistivity of the overcoat material is between about $10^8$ to $10^{14}$ Ohm-cm. With the exception that the materials may have a different electrical conductivity and a higher Young's modulus, the chemical nature of the materials useful for the overcoat layer can be similar to (from the same chemical families) those useful for the blanket layer. Examples of suitable materials for the overcoat layer are listed above for the blanket layer. Other suitable materials include diamond-like carbon, cerimers, and polyimides. The currently preferred overcoat material is polyurethane.

Although it is not necessary for image quality to transfer all the non-marking toner from the ITM to the receiver, it is preferred to transfer the majority, if not all, the non-marking toner from the ITM to the receiver.

The transfer of toner from the ITM to the receiver can be done by any known method including corona transfer or roller transfer. It is preferred in all the embodiments of the invention that a receiver is passed between a nip formed by a backup roller and the ITM to transfer the toner from the ITM to the receiver. The preferred backup roller consists of a metal core having an electrically biased polymer coating having a resistivity of $10^7$ to $10^{12}$ Ohms-cm. A preferred backup roller is disclosed in Zaretsky et al, U.S. Pat. No. 5,187,526, incorporated herein by reference. Typically after the toner particles have been transferred to the receiver, the toner particles are fused to the receiver by a heat and pressurized contact fuser system, preferably consisting of a heated fuser roller and pressure roller. Fuser systems are well known to a person of ordinary skill in the art.

The "non-marking toner", collectively referred to as "non-marking toner particles" is a dry toner composition including a thermoplastic polymer. The thermoplastic polymer preferably has a glass transition temperature in the range of about 50° C. to about 90° C., or if the thermoplastic polymer is a semicrystalline polymer, it preferably has a glass transition temperature in the range of about 50° C. to about 140° C. Thermoplastic polymers which have somewhat higher and lower Tgs can be employed. This range of Tgs is typical for toners that are heat and contact fused to the receiver when a toner bearing receiver is passed through a nip formed by a fuser roller and pressure roller.

The non-marking toner particles employed in the practice of this invention have a particle size preferably less than 15 μm, and more preferably less than 9 μm.

The non-marking toner particles preferably utilize a polymer which is substantially transparent to visible light when fused. Such particles preferably contain substantially no colorant (i.e., a dye or pigment). However, if desired, a small amount colorant may be incorporated into the non-marking toner particles. One reason, for example, that it may be desirable to add colorant to the non-marking toner is to change the color balance of a final toner image.

The non-marking toner particles can be formulated to contain abrasion-resistant materials such as $C_8$ to $C_{30}$ aliphatic amines, aliphatic acids and metal salts of such aliphatic amines and acids, preferably stearamide, e.g. Kemamide®S manufactured by Witco Corporation. The preferred non-marking toner is unpigmented toner which is transparent to visible light after fusing. Preferred non-marking toners are disclosed by Tyagi et al; MONODISPERSE SPHERICAL TONER PARTICLES CONTAINING ALIPHATIC AMIDES OR ALIPHATIC ACIDS; Provisional U.S. Ser. No. 60/003,081 filed Aug. 31, 1995, now U.S. Ser. No. 08/672,172 filed Jun. 25, 1996, and incorporated herein by reference.

The "marking toner", collectively referred to as "marking toner particles" employed in the practice of the invention is a dry toner composition preferably having particle sizes less than 15 μm, more preferably less than 9 μm and preferably including a thermoplastic polymer which preferably has a Tg in the range of about 50° C. to about 90° C.

The marking toner particles preferably are compounded with a colorant having the appropriate color for a desired toner image. Black is a preferred color. When multi-colored toner images are made by the method of this invention, the marking toner particles need to be prepared with appropriate colorants. Conventional colorants of any color can be employed to make the marking toners, however, cyan, magenta and yellow toner particles are the preferred color toners for making multi-color toner images.

The marking and non-marking toner particles likewise preferably contain a charge agent. On a 100 weight percent basis, preferred toner particles comprise about 0.05 to about 5 weight percent of charge agent. Suitable charge control agents are disclosed, for example, in U.S. Pat. Nos. 3,893,935; 4,079,014; 4,323,634; 4,394,430, 4,624,907; 4,814,250; 4,840,864; 4,834,920; 4,683,188 and 4,780,553 and British Patent Nos. 1,501,065; and 1,420,839. Mixtures of charge control agents can also be used.

In addition, the marking toner particles contain about 1 to about 30, preferably 2 to about 15 weight percent of colorant. Suitable dyes and pigments am disclosed, for example, in U.S. Reissue Pat. No. 31,072 and in U.S. Pat. Nos. 4,160,644; 4,416,965; 4,414,152 and 2,229,513.

Both the non-marking and the marking toner particles can be comprised of polymers such as, homopolymers and copolymers of styrene and condensation polymers such as polyesters and copolyesters. Particularly useful binder polymers are styrene polymers of from 40 to 100 percent by weight of styrene or styrene homologs and from 0 to 45 percent by weight of one or more lower alkyl acrylates or methacrylates. Fusible styrene-acrylic copolymers which are covalently lightly crosslinked with a divinyl compound such as divinylbenzene, as disclosed in U.S. Reissue Pat.

No. 31,072, are particularly useful. Also especially useful are polyesters of aromatic dicarboxylic acids with one or more aliphatic diols, such as polyesters of isophthalic or terephthalic acid with diols such as ethylene glycol, cyclohexane dimethanol and bisphenols. The polymers for each of the toners that are used in the process can be the same or different.

The polymers in both the marking and non-marking toner particles more preferably have glass transition temperatures or Tgs in the range of about 55 ° C. to 70° C. Preferably such toner particles also have relatively high caking temperatures, for example, higher than about 55° C., so that the toner particles can be stored for relatively long periods of time at relatively high temperatures with little or no individual particle agglomeration or clumping. Useful marking and non-marking toners are commercially available.

The preferred marking toner particles have submicrometer particles appended to the surface of the marking toner particles so as to facilitate transfer. These submicrometer particles will be referred to as "transfer assisting addenda." Preferred addenda are inorganic particles such as silica and titanium dioxide, however, organic particles can also be used. The use of toners with these addenda is further described in the invention of Tombs, May and Gomes; APPARATUS AND METHOD OF TRANSFERRING TONER USING NON-MARKING TONER AND MARKING TONER; U.S. Provisional application Ser. No. 60/003,013 filed on Aug. 31, 1995, and incorporated herein by reference. Toners having transfer assisting addenda are commercially available from Ricoh, Canon, and other toner suppliers.

Single component developer compositions can be used in the method of this invention; however, it is presently preferred that the non-marking and marking toners of this invention are used in a two component developer composition consisting of a mixture of distinct toner particles and carrier particles. Mixing of the carrier particles with the toner particles in the developer stations triboelectrically charges the toner.

It is preferred that the polarity of the charge on the marking toners and the non-marking toners is the same. In the currently preferred process, the marking and the non-marking toners are both positively charged. Further, the currently preferred process uses developer consisting of toner particles and magnetic carrier particles.

FIG. 1 shows a parallel intermediate transfer apparatus of the invention. The parallel transfer apparatus has four imaging modules 20, 30, 40, 50, an intermediate transfer member 10 and backup roller 60. Each module consists of an imaging member 25, 35, 45, 55; development station 24, 34, 44, 54; charger 22, 32, 42, 52; cleaner 21, 31, 41, 51; exposing device 23, 33, 43, 53 and transfer nip 26, 36, 46 and 56. Each of the imaging members 25, 35, 45, 55 is in transfer relationship with ITM 10. The ITM 10 has a cleaner 11, and a development station 14 for non-marking toner in transfer relation with the ITM. Referring to FIG. 1, in the method of this invention, non-marking toner is transferred from development station 14 by a transfer voltage applied between the ITM 10 and the development station 14. The non-marking toner is applied uniformly to an imaging frame on the surface of the ITM 10 as the ITM moves past development station 14 in the direction indicated by arrow 205. The imaging modules in series create the yellow, magenta, cyan, and black portions for a single desired final toner image, and the modules can simultaneously create the yellow, magenta, cyan, and black portions of up to four desired final toner images. In this method, imaging member 55 rotates in the direction indicated by arrow 204 past common electrophotographic imaging stations. In order, imaging member 55 is cleaned by cleaner 51, charged by charger 52 to create a uniform electrostatic charge on imaging member 55, exposed by exposing device 53 to create an electrostatic image corresponding to the yellow portion of a first desired final toner image, the electrostatic image is toned at development station 54 to form a toned electrostatic image for all the yellow portions of a final desired toner image and the yellow toned electrostatic image is transferred to the ITM 10 over the non-marking toner at transfer nip 56. At the same time as the yellow toner image is created and transferred to the ITM, non-marking toner is applied from development station 14 to a second frame on ITM 10. Next, the process of creating a toned electrostatic image is repeated in module 40 for the magenta portion of the first final toner image, and the ITM 10 moves into transfer position with imaging member 45 so that the magenta toner image is transferred in registration over the yellow toner image. At the same time that module 40 creates and transfers the magenta portion of the first final toner image to the ITM, module 50 creates and transfers the yellow portion of a second final toner image to the second frame on the ITM 10 over the non-marking toner. Next, module 30 creates the cyan portion of the first final toner image and it is transferred to the ITM 10 over and in registration with the magenta toner image and the yellow toner image. At the same time, module 40 creates and transfers the magenta portion of the second final toner image and transfers it to the ITM over and in registration with the yellow portion of the second final toner image, and module 50 creates the yellow portion of a third final toner image and transfers it to a third frame on the ITM 10 over non-marking toner. This pattern is repeated for all the final toner images to be made. Prior to the transfer of any yellow toner images from imaging member 55 to the ITM, non-marking toner is applied to the ITM from development station 14. After the black toner image from module 20 is transferred to the ITM 10 from imaging member 25 in registration with the cyan, magenta, and yellow toner images of a final toner image, receiver 70 is fed into the transfer nip 80 formed between the backup roller 60 and the ITM 10. The multi-color toner image consisting of all the color toner images in registration on the ITM 10 is transferred to the receiver 70 urged by a transfer voltage formed between the ITM 10 and the backup roller 60. The multi-color image on the receiver is then usually fused in a contact, heated fuser system (not shown).

FIG. 2 shows a second embodiment of an image-forming apparatus for carrying out the method of the invention. The apparatus consists of an imaging member 75, an ITM 10 and a backup roller 60. Around the imaging member 75 is a cleaner 71, charger 72, exposing device 73, the ITM 10 and development stations 74, 84, 94 and 104 which can be moved into and out of position for toning the imaging member 75. A transfer nip 76 is formed where imaging member 75 contacts the ITM 10. Development stations 74, 84, 94, and 104 each contain different color toners, e.g. yellow, magenta, cyan, and black. Intermediate transfer member 10 has a cleaner 11 and a development station 14 for non-marking toner in transfer relationship with the intermediate transfer member. The backup roller 60 can be moved into and out of contact with the ITM 10.

According to FIG. 2, in the process of this invention ITM 10 rotates in the direction indicated by arrow 206 past cleaner 11 and past development station 14 where an imaging frame on the ITM 10 is toned with a non-marking toner from development station 14. At the same time, the imaging member 75 rotates in the direction indicated by arrow 207 past common electrophotographic stations. In order, imaging member 75 is cleaned by cleaner 71, and charged by a charger 72 which uniformly charges the image surface of imaging member 75. The uniformly charged image surface is imagewise exposed by an exposing device 73 to create an electrostatic image on imaging member 75, which corresponds to a single color separation. The electrostatic image on the imaging member 10 is toned when one toner station containing the color toner corresponding to the color separation formed on the imaging member 75 moves into position for toning the electrostatic image, creating a first single color toned electrostatic image, also referred to as a first color toner image. Development station 74 is shown in position for toning the electrostatic image. The first single color toned electrostatic image is then transferred from imaging member 75 to the ITM 10 over the non-marking toner on the ITM 10. The transfer from the imaging member 75 to the ITM 10 occurs in the transfer nip 76 created where the imaging member 75 contacts the ITM 10. Then, the imaging member is cleaned by cleaner 71, charged by charger 72, and exposed by exposing device 73 to create an electrostatic image for a second color separation on the imaging member 10 and toned when a second toner station is moved into position for toning the electrostatic image on the imaging member 75. The second single color toned electrostatic image on the image member 75 is then transferred in the transfer nip 76 over and in registration with the first color toner image on the ITM 10. These steps are repeated for the other color separations in an image. There are four color separations, typically yellow, magenta, cyan, and black with the development stations 74, 84, 94 and 104 containing these color toners. After the four color toner images have been transferred sequentially in registration to the ITM 10, a receiver 70 is fed in the direction indicated by arrow 208 into the nip 80 formed between the ITM 10 and the backup roller 60 and the color toners are simultaneously transferred to the receiver. Usually the toner on the receiver is then fused in a heated, contact fuser system (not shown).

It will be readily apparent that numerous variations and permutations of these steps or additional other steps can be used in the method of this invention. Also the apparatus of this invention can be constructed with additional features, such as digital scanners and computers as described above to analyze the color information of a final toner image. An application for a related invention by May, Tombs and Tyagi entitled MULTI-COLOR METHOD OF TONER TRANSFER USING NON-MARKING TONER AND HIGH PIGMENT MARKING TONER; U.S. Ser. No. 08/572,360 filed Dec. 14, 1995, is fully incorporated herein by reference.

The following examples are presented for a further understanding of the invention.

For the purposes of the examples, "overall transfer efficiency" refers to the percentage of the toner, initially on the imaging member, that is transferred to the receiver. "ITM transfer efficiency" refers to the percentage of the toner, initially on the imaging member, transferred to the ITM. "Receiver transfer efficiency" refers to the percentage of the toner, initially on the ITM, transferred to the receiver.

Example 1

An intermediate transfer member system was used to compare the transfer performance of a compliant ITM with and without a non-marking toner.

The intermediate transfer system included a photoconductive element, an ITM system which had a roller and a backup roller. The photoconductive element was an organic photoconductor as found in the Kodak 2100 Copier Duplicator®.

The ITM consisted of two layers over an aluminum core. The blanket was 5.1 mm thick and was composed of polyurethane doped with antistat to yield a resistivity of $10^9$ Ohm-cm. The Young's modulus of the blanket was $2\times10^6$ Newtons/m$^2$. The overcoat was a urethane resin sold under the trade name Permuthane® by Stahl Finish. The thickness of the overcoat on the ITM was 12 μm, the Young's modulus was $320\times10^6$ Newtons/m$^2$, and the resistivity was $10^{12}$ Ohm-cm. The diameter of the ITM was 146 mm.

The ITM was prepared as follows:

TU-400 is a commercially available two part polyurethane system from Conap, Inc., Olean, N.Y. TU-400 Part A is a polyisocyanate resin and TU-400 Part B is a hardening agent consisting primarily of a chain extender and a catalyst. Antistat 1 is a complex of one mole sodium iodide with three moles diethylene glycol. To a three liter glass kettle containing 7.876 grams Antistat 1, 1041.240 grams TU-400 Part B were added. The mixture was mechanically stirred for three minutes at room temperature. 1601.18 grams of TU-400 Part A were added to the kettle and the reaction was mixed under nitrogen for five minutes. The incorporated nitrogen was removed under reduced pressure (0.1 mm Hg) and the mixture was poured into a prepared mold with a roller core in the middle. The polyurethane was cured at 80° C. for sixteen hours. After eighteen hours, the roller was removed from the mold and ground to 14.6 cm. The roller was then overcoated with 12 μm layer of Permuthane U6729 from Stahl Finish.

To achieve transfer from the ITM to the receiver, the receiver was passed through the nip formed by the ITM and the backup roller. The backup roller was a steel core with a layer of polyurethane doped with antistat to achieve a resistivity of $2\times10^9$ Ohm-cm. The thickness of the blanket was 5.1 mm and the Young's modulus was $40\times10^6$ Newtons/m$^2$. The diameter of the backup roller was 37 mm.

The marking toner was a 3.5 μm diameter (volume weighted) particle dry toner made by the limited coalescence process (silica stabilized). The binder was Piccotoner® 1221 binder, a styrene butylacrylate copolymer (80/20), available from Hercules Sanyo Inc. The pigment was bridged aluminum phthalocyanine, 12.5% by weight of the toner. The charge agent was tetradecylperidinium tetraphenyl borate, 0.4% by weight of the toner. The charge to mass ratio of the toner was 62 μC/g and the toner concentration of the developer was 6% by weight of the developer. The marking toner had 0.1 μm diameter silica particles, T604 from DeGussa Corp. (transfer assisting addenda) adhering to the surface of the toner particles (0.5% by weight based on the weight of the toner particles). The transfer assisting particles were dry blended using a Hobart mixer with the toner particles to achieve a uniform distribution of triboelectrically adhered and/or embedded transfer assisting particles on the toner particles. The carrier was a lanthanum doped hard ferrite core coated with a 1:1 blend of a polyvinylidene fluoride, Kynar 301 F (Penwalt Corp.) and polymethylmethacrylate made as described in U.S. Pat. No. 4,764,445.

The non-marking toner $T_g$=63° C., was a 3.8 μm diameter toner made by the limited coalescence process (latex stabilized, Piccotoner 1221® binder, Hercules Chemical, 10% stearamide, 0.25% octadecyl methyl ammonium dinitrobenzene sulfonate). The charge to mass ratio of the toner was 95 μC/g and the toner concentration of the developer was 6%. The carrier was the same as the one used for the marking toner.

Two-component development and the method of depositing the marking and non-marking toners onto a conventional organic photoconductor were as found for the marking toners in the Kodak Coloredge Copier Duplicator®. The non-marking toner was uniformly developed on an image frame on the photoconductor by applying 120 V to the toning shell of the development station. The non-marking toner particles were then transferred to the ITM.

The marking toner was then developed on a single frame of the same photoconductor to yield a toner scale or patches having a range of image densities. The entire marking toner frame was then transferred to the ITM by applying 700 V to the core of the ITM. The patches and non-marking toner were then transferred to a clay coated paper (Krome Kote®) in the transfer nip formed by the ITM and the backup roller by applying a potential difference of 2300 V between the ITM and the backup roller.

For comparison purposes, the non-marking toner was developed and transferred to the ITM so as to be present under half of the marking toner patches for the full toner scale. The final images were fused in an oven at 160° C. for 30 seconds.

With the non-marking toner, improvements in the transfer efficiency were demonstrated in both the transfer from the imaging surface to the ITM and from the ITM to a receiver.

Figure 3A:
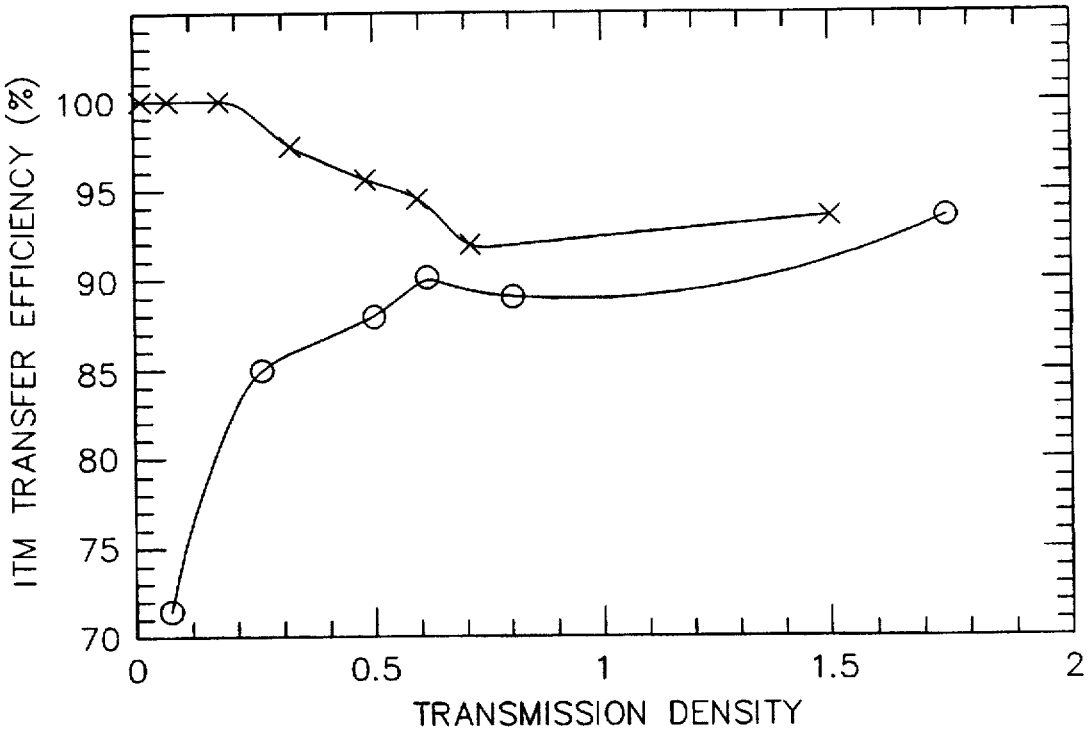
FIGS. 3*a–c* are plots of the transfer efficiencies for a method according to Example 1.
Figure 3B:
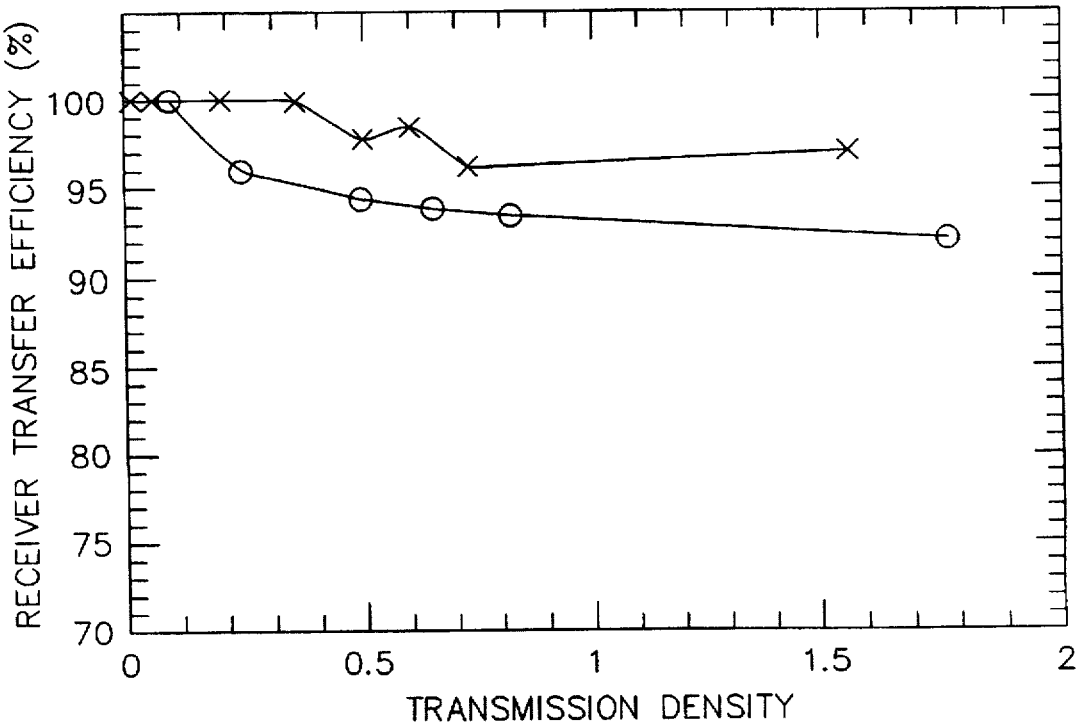
Figure 3C:
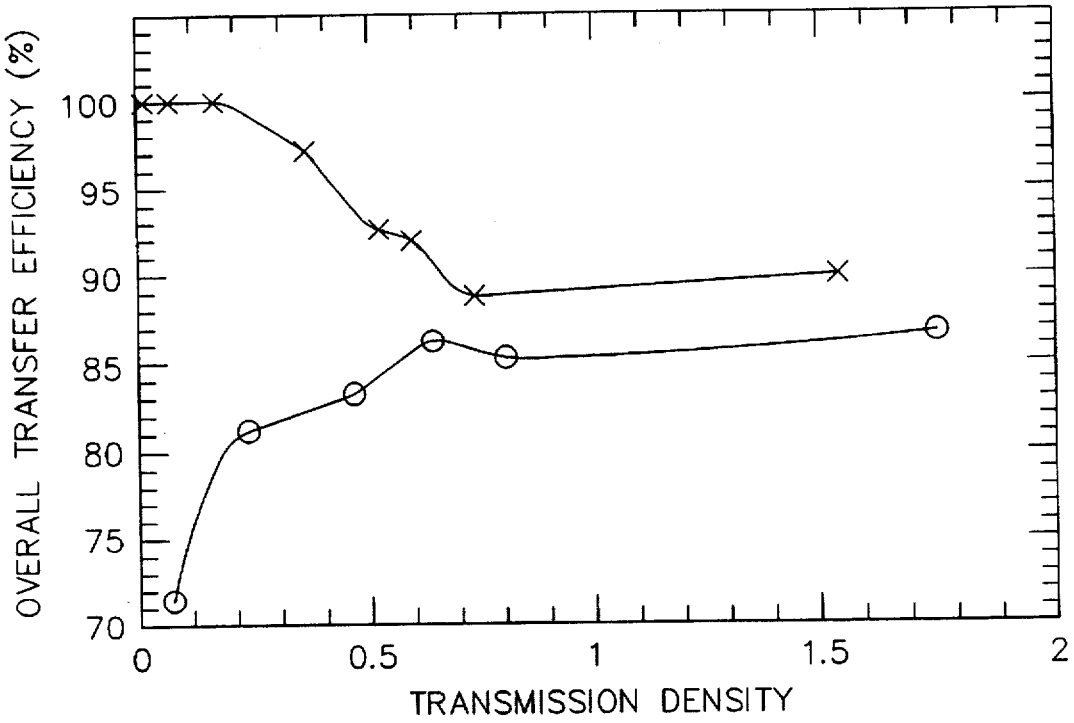

The data generated in the Example 1 experiments is tabulated in Table 1, and shown in FIGS. 3*a*, 3*b* and 3*c*.

FIG. 3*a* shows the improvements realized in the ITM Transfer Efficiency, particularly in the low density areas. The curve marked by —O—, indicates the ITM Transfer Efficiency of the marking toner without a layer of non-marking toner in contact with the ITM under the marking toner. The curve marked by —X—, indicates the ITM Transfer Efficiency of the marking toner when the non-marking toner was in contact with the ITM. The presence of the non-marking toner on the ITM produced an unexpected and large improvement in the ITM Transfer Efficiency.

Similarly, FIG. 3*b* shows the Receiver Transfer Efficiency and FIG. 3*c* shows the Overall Receiver Transfer Efficiency. The curves were interpolated to fit the data.

Further, it was observed that mottle decreased when non-marking toner was applied to the ITM, especially in low density areas.

TABLE 1

(Data for FIGS. 3a, 3b and 3c)

| Transmission Density | ITM Transfer Efficiency | Receiver Transfer Efficiency | Overall Transfer Efficiency |
|---|---|---|---|
| | With Non-Marking Toner on ITM | | |
| 0.01 | 100.00% | 100.00% | 100.00% |
| 0.05 | 100.00% | 100.00% | 100.00% |
| 0.16 | 100.00% | 100.00% | 100.00% |
| 0.33 | 97% | 100.00% | 97.00% |
| 0.47 | 95.70% | 97.80% | 93.60% |
| 0.57 | 94.70% | 98.10% | 93.00% |
| 0.7 | 91.40% | 96.90% | 88.60% |
| 1.54 | 92.90% | 97.20% | 90.30% |
| | Without Non-Marking Toner on ITM | | |
| 0.07 | 71.40% | 100.00% | 71.40% |
| 0.28 | 85.70% | 95.80% | 82.10% |
| 0.48 | 87.50% | 95.20% | 83.30% |
| 0.63 | 90.50% | 94.70% | 85.70% |

TABLE 1-continued (Data for FIGS. 3a, 3b and 3c)

| Transmission Density | ITM Transfer Efficiency | Receiver Transfer Efficiency | Overall Transfer Efficiency |
|---|---|---|---|
| 0.78 | 89.70% | 94.30% | 84.60% |
| 1.73 | 93.10% | 93.20% | 86.70% |

Example 2

Excellent results were also achieved using the same process and parameters as in Example 1 except that a different ITM and different marking toner were used. The ITM was a roller consisting of a blanket layer and an overcoat. The blanket consisted of polyurethane doped with antistat having a resistivity of $4\times10^8$ Ohms-cm, a thickness of 5.1 mm, and a Young's modulus of $3.8\times10^6$ Newtons/m$^2$. The overcoat consisted of Permuthane® available from ICI, 12 μm thick.

The ITM was prepared as follows:

L42 is a polyisocyanate resin available from Uniroyal. EC-300 is an amine chain extender available from Ethyl Corporation. Antistat 2 is a complex of one mole ferric chloride and three moles diethylene glycol. To a three liter glass beaker containing 0.437 grams Antistat 2, 43.27 grams tetraethylene glycol were added and the mixture was stirred for five minutes. 846.76 grams of L42 resin were added and the reaction was stirred for two minutes. 9.53 grams of EC-300 were added and the reaction was stirred for five minutes and then the air was removed under reduced pressure (0.10 mm Hg). The resulting mixture was poured into a prepared mold with a roller core in the middle and the polyurethane was cured at 80° C. for eighteen hours. The roller was removed from the mold and ground to a specified diameter. The roller was then overcoated with a thin 12 μm layer of Permuthane U6729.

The marking toner was the same as in Example 1 except that it had no silica transfer assisting addenda.

Figure 4:
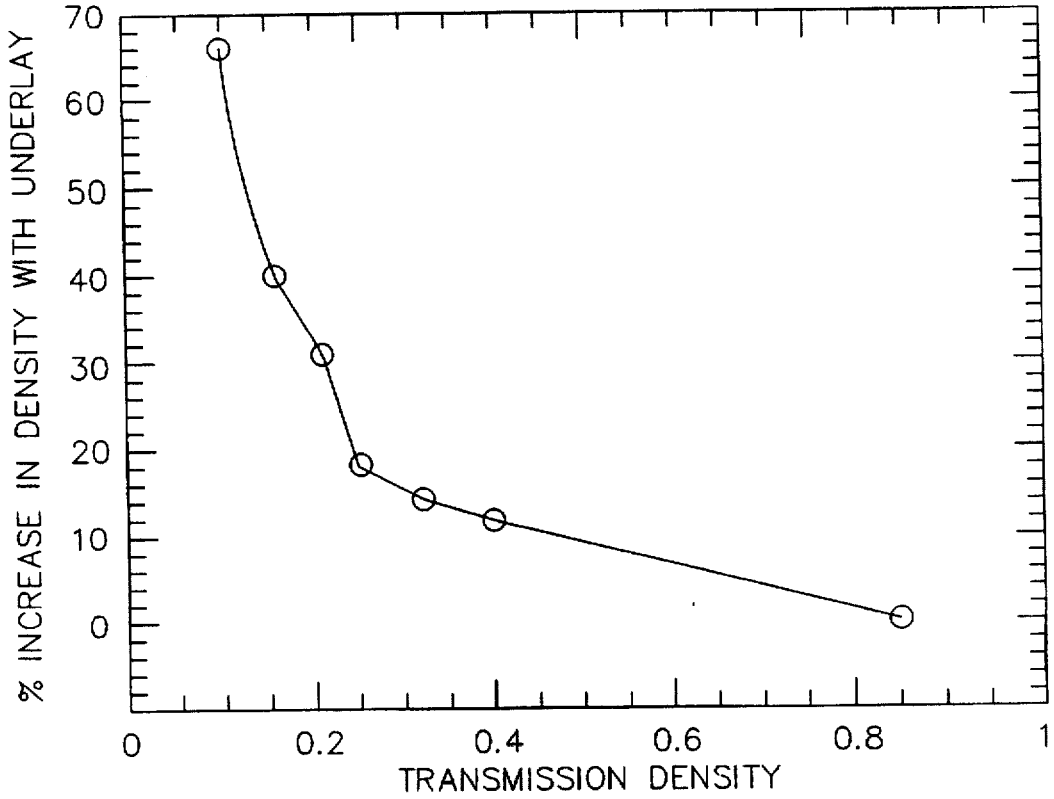
FIG. 4 is a plot of the increase in toner density for a method according to Example 2.

The results of Example 2 are tabulated in Table 2 and shown in FIG. 4. FIG. 4 shows the overall percent increase in density on the receiver caused by applying non-marking toner to a compliant ITM of the invention. The presence of the non-marking toner on the compliant ITM, reduced the mottle of the fused toner image.

TABLE 2

(Data for FIG. 4)

| Transmission Density without Non-Marking Toner | % Increase in Density with Non-Marking Toner |
|---|---|
| 0.1 | 66.667 |
| 0.15 | 40.625 |
| 0.2167 | 30 |
| 0.26 | 16.418 |
| 0.32 | 14.286 |
| 0.4 | 12.15 |
| 0.8467 | −0.394 |

Example 3

Example 2 was repeated except that Hammermill Laser Print paper was used. Similar results were obtained.

The apparatus and method of this invention have been described with reference to particular embodiments. It is understood that various modifications can be made to the preferred apparatus and method of this invention without departing from the spirit and scope of this invention.

What is claimed is:

1. A method of forming a desired toner image on a receiver, said method comprising:

forming at least one electrostatic image on at least one imaging member;

toning at least one said electrostatic image with marking toner particles;

transferring said marking toner particles from at least one said imaging member to the surface of an intermediate transfer member in the presence of an electric field which urges said marking toner particles toward said intermediate transfer member; and transferring said marking toner particles from said intermediate transfer member to a receiver in the presence of an electric field which urges said marking toner particles toward said receiver;

wherein, when transferring said marking toner particles to said intermediate transfer member from at least one said imaging member, said surface of said intermediate transfer member contacts non-marking toner particles in some areas which receive marking toner particles, and wherein said intermediate transfer member comprises a blanket layer having a Young's modulus of about $10^8$ Newtons/$m^2$ or less.

2. The method of claim 1, wherein when transferring said marking toner particles to said intermediate transfer member, said surface of said intermediate transfer member contacts non-marking toner particles only in areas which receive marking toner particles below a predetermined transmission density.

3. The method of claim 1, wherein when transferring said marking toner particles to said intermediate transfer member, said surface of said intermediate transfer member contacts non-marking toner particles only in areas which receive marking toner particles below a transmission density of 0.6; said transmission density being measured on a toner image of said marking toner particles after fusing said toner image of said marking toner particles to a receiver in a convection oven at 160° C. for thirty seconds.

4. The method of claim 1, wherein when transferring said marking toner particles to said intermediate transfer member, said surface of said intermediate transfer member contacts non-marking toner particles only in areas which receive less than the amount of marking toner particles required to achieve the maximum reflection density for a fused toner image of said marking toner particles, said reflection density being measured on a toner image of said marking toner particles after fusing said marking toner particles to a receiver in a convection oven at 160° C. for thirty seconds.

5. The method of claim 1, wherein when transferring said marking toner particles to said intermediate transfer member, said surface of said intermediate transfer member contacts non-marking toner particles only in areas which receive marking toner particles below a transmission density of 1.8; said transmission density being measured on a toner image of said marking toner particles after fusing said marking toner particles to a receiver in a convection oven at 160° C. for thirty seconds.

6. The method of claim 1, further comprising, prior to said step of transferring said marking toner particles from at least one said imaging member to the surface of an intermediate transfer member, the step of directly applying non-marking toner particles to said surface of said intermediate transfer member from a development station for non-marking toner particles.

7. The method of claim 1, further comprising, prior to said step of transferring said marking toner particles from at least one said imaging member to the surface of an intermediate transfer member, the steps of:

applying non-marking toner particles to at least one said imaging member; and transferring said non-marking toner particles from at least one said imaging member to said surface of said intermediate transfer member.

8. The method of claim 1, further comprising prior to said step of transferring said marking toner particles from at least one said imaging member to the surface of an intermediate transfer member, the steps of:

forming an electrostatic image on an imaging member corresponding to all the areas of marking toner in a desired toner image;

toning said electrostatic image with non-marking toner particles; and transferring said non-marking toner particles to the surface of the intermediate transfer member.

9. The method of claim 1, wherein said blanket layer of said intermediate transfer member has an electrical resistivity of $10^6$ to $10^{12}$ Ohm-cm.

10. The method of claim 1, wherein said blanket of said intermediate transfer member has an overcoat having a Young's modulus greater than $10^8$ Newtons/$m^2$ and has a thickness of 20 μm or less.

11. The method of claim 10, wherein said overcoat has an electrical resistivity of $10^8$ to $10^{14}$ Ohm-cm.

12. The method of claim 1, wherein said blanket of said intermediate transfer member has a Young's modulus of $10^6$ to $5\times10^7$ Newtons/$m^2$ and has a thickness of 0.5 to 10 mm.

13. The method of claim 12, wherein said blanket of said intermediate transfer member has a Young's modulus of $2\times10^6$ to $10^7$ Newtons/$m^2$.

14. The method of claim 1, wherein said non-marking toner particles have a mean volume weighted diameter of 2 to 15 μm.

15. The method of claim 1, wherein said non-marking toner particles have a mean volume weighted diameter of 3 to 9 μm.

16. The method of claim 1, wherein the polarity of the marking toner particles and the non-marking toner particles are the same.

17. The method of claim 1, wherein said marking toner particles include transfer assisting addenda.

18. The method of claim 1, wherein said blanket layer of said intermediate transfer member comprises polyurethane.

19. The method of claim 18, wherein said intermediate transfer member further comprises an overcoat comprising polyurethane.

20. The method of claim 1, wherein said steps of forming, toning and transferring said marking toner particles from at least one said imaging member are further characterized by the following steps:

forming and toning at least two electrostatic images on the same frame of an imaging member with marking toners of at least two different colors;

simultaneously transferring said marking toners of at least two different colors simultaneously from said imaging member to the surface of an intermediate transfer member in the presence of an electric field which urges said marking toner particles toward said intermediate transfer member.

21. The method of claim 1, wherein said steps of forming, toning and transferring said marking toner particles from one or more said imaging member are further characterized as comprising the following steps:

forming on an imaging member an electrostatic image corresponding to one color in said desired toner image;

toning by applying the corresponding color marking toner particles to said electrostatic image to form an individual color toner image;

transferring said individual color toner image to the surface of an intermediate transfer member in the presence of an electric field which urges said individual toner images toward said intermediate transfer member;

and repeating said forming, toning and transferring steps for each color separation so that said individual color toner images are in registration on said surface of said intermediate transfer member.

22. The method of claim 21, wherein the step of transferring said individual color toner images from said intermediate transfer member to a receiver occurs when said receiver is passed through a nip formed by said intermediate transfer member and a backup roller, said backup roller having a resistivity of $10^7$ to $10^{12}$ Ohms-cm.

23. The method of claim 21, further comprising, prior to said step of transferring said individual color toner image from to the surface of an intermediate transfer member, the steps of:

applying non-marking toner particles to an imaging member; and transferring said non-marking toner particles to said surface of said intermediate transfer member.

24. The method of claim 21, further comprising prior to the step of transferring said individual color toner image to the surface of an intermediate transfer member, the step of directly applying said non-marking toner particles to said surface of said intermediate transfer member.

25. The method of claim 21, further comprising, prior to said step of transferring said individual color toner image to the surface of an intermediate transfer member, the steps of forming an electrostatic image for non-marking toner on said imaging member which corresponds to all areas of marking toner in a desired toner image and applying non-marking toner particles to said electrostatic image for non-marking toner; and transferring said non-marking toner particles from said imaging member to said intermediate transfer member.

26. The method of claim 24, wherein said blanket of said intermediate transfer member has a Young's modulus of $10^6$ to $5\times10^7$ Newtons/m$^2$.

27. The method of claim 1, further comprising after said step of toning at least one said electrostatic image with marking toner particles, the additional step of applying non-marking toner particles over said marking toner particles on at least one said electrostatic image.

28. The method of claim 27, wherein said step of depositing non-marking toner particles over said marking toner particles on an electrostatic image is accomplished by forming a second electrostatic image over said marking toner particles on at least one said imaging member and toning by applying to said electrostatic image the non-marking toner particles over said marking toner particles.

29. The method of claim 1, wherein said step of transferring said marking toner particles from said intermediate transfer member to a receiver is accomplished by passing said receiver through a nip formed by said intermediate transfer member and a backup roller, having a resistivity of $10^7$ to $10^{12}$ Ohm-cm.

30. The method according to claim 1, wherein the amount of said non-marking toner particles contacting said intermediate transfer member is at least a monolayer of non-marking toner particles.

31. The method according to claim 1, wherein the amount of said non-marking toner particles contacting said intermediate transfer member is between a monolayer and three layers of non-marking toner particles.

32. The method of claim 1 further comprising prior to said forming step the steps of:

inputting image information of a desired toner image into a digital computer;

analyzing said image information to establish bit maps for each color separation in a desired toner image;

and wherein said forming step is further characterized in that said bit maps are used to control an exposing device when forming each electrostatic image on at least one imaging member, each said electrostatic image for toning with a corresponding color marking toner.

33. The method of claim 32, further comprising prior to the step of transferring said marking toners, the steps of:

establishing a bit map for the non-marking toner;

forming an electrostatic image on an imaging member for said non-marking toner;

toning said electrostatic imaging member with non-marking toner particles;

and transferring said non-marking toner particles to the surface of an intermediate transfer member in the presence of an electric field which urges said non-marking toner particles to said intermediate transfer member;

whereby the amount of said non-marking toner particles contacting said intermediate transfer member levels the stack-heights of said non-marking toner particles and marking toner particles on said intermediate transfer member.

34. The method of claim 1, further comprising prior to the step of transferring said marking toners, the steps of:

inputting image information of a desired toner image into a digital computer;

analyzing said image information;

establishing at least two bit maps for each color separation in a desired toner image;

establishing a bit map for the non-marking toner;

forming an electrostatic image on an imaging member for said non-marking toner;

toning said electrostatic image with non-marking toner particles; and transferring said non-marking toner particles to the surface of an intermediate transfer member in the presence of an electric field which urges said non-marking toner particles to said intermediate transfer member;

and wherein said steps of forming at least one electrostatic image, toning at least one electrostatic image with marking toner particles and transferring said marking toner particles from at least one said imaging member are further characterized as comprising:

forming at least two electrostatic images on at least one imaging member by using said bit maps for each color separation to control at least one exposing device;

toning said electrostatic images with the corresponding color marking toner to form at least two individual marking toner images; and transferring at least two said individual marking toner images in series and in registration to the surface of an intermediate transfer member in the presence of an electric field which urges said marking toner particles toward said intermediate transfer member, whereby non-marking toner contacts the intermediate transfer member in areas where said color marking toner particles of the first individual marking toner image to be transferred to the intermediate transfer member are present in an amount below a predetermined transmission density and where said color marking toner particles of said first individual marking toner image and said second individual marking toner image to be transferred to the intermediate transfer member are at a combined density below said predetermined transmission density.

35. An apparatus comprising:

at least one imaging member;

means for establishing imagewise electrostatic charge on at least one said imaging member;

at least one development station for marking toner;

an intermediate transfer member comprising a blanket layer having a Young's modulus of about $10^8$ Newtons/$m^2$ or less; and means for applying at least a monolayer of non-marking toner particles to the intermediate transfer member at least in some areas to receive marking toner particles.

36. The apparatus of claim 35, wherein said apparatus further comprises a backup roller having a resistivity of $10^7$ to $10^{12}$ Ohms-cm, and said blanket of said intermediate transfer member comprises polyurethane having a conductivity enhancing material.

37. The apparatus of claim 35, wherein said means for applying at least a monolayer of non-marking toner comprises a bias development station for the non-marking toner.

38. The apparatus of claim 35, further comprising a digital computer for analyzing the image information in a desired toner image to establish a bit map for the areas on the intermediate transfer member to receive non-marking toner.

39. The apparatus of claim 35, wherein said blanket layer of said intermediate transfer member has a resistivity of $1\times10^6$ to $1\times10^{12}$ Ohm-cm.

40. The apparatus of claim 35, wherein said blanket layer of said intermediate transfer member has an overcoat layer.

* * * * *